US005221950A

United States Patent [19]

Ford et al.

[11] Patent Number: 5,221,950

[45] Date of Patent: Jun. 22, 1993

[54] DEVICE FOR CORRECTING FOR CORRUGATION INDUCED IN A SHEET AS A RESULT OF PASSING THROUGH TRANSPORT NIPS

[75] Inventors: Brian R. Ford, Walworth; Glenn M. Keenan; Kenneth P. Moore, both of Rochester, all of N.Y.

[73] Assignee: Xerox Corporation, Stamford, Conn.

[21] Appl. No.: 888,103

[22] Filed: May 26, 1992

[51] Int. Cl.[5] ..... G03G 21/00

[52] U.S. Cl. ..... 355/309; 162/271; 271/161; 271/188; 271/209

[58] Field of Search ..... 271/188, 209, 161, 272, 271/273; 355/308, 309, 200; 162/270, 271; 33/412; 29/464, 467; 403/1, 13, 359; 116/230, DIG. 21

[56] References Cited

U.S. PATENT DOCUMENTS

| | | | |
|---|---|---|---|
| 3,012,301 | 12/1961 | Rogers et al. | 162/270 X |
| 3,434,710 | 3/1969 | Yarger et al. | 271/188 |
| 4,025,187 | 5/1977 | Taylor et al. | 355/309 X |
| 4,089,378 | 5/1978 | Suzuki | 355/309 X |
| 4,116,558 | 9/1978 | Adamek et al. | 355/24 |
| 4,744,555 | 5/1988 | Naramore et al. | 271/209 X |
| 4,780,746 | 10/1988 | Naramore et al. | 355/309 |
| 4,791,457 | 12/1988 | Shida | 355/309 |
| 5,048,813 | 9/1991 | Wierszewski et al. | 271/98 |

FOREIGN PATENT DOCUMENTS

| | | | |
|---|---|---|---|
| 0046835 | 2/1987 | Japan | 271/161 |

*Primary Examiner*—A. T. Grimley
*Assistant Examiner*—Robert Beatty

[57] ABSTRACT

An idler roller assembly that prevents jams and image deletion in copier/printers by removing any corrugation in sheets before they reach sharp turns includes a shaft onto which idler rollers are mounted with the shaft having a bend in the middle in order to provide a "toe out" condition to steer out any existing sheet corrugation. An alignment member is attachable to the shaft in order to prevent mis-installation of the shaft in its mounting support.

4 Claims, 2 Drawing Sheets

DEVICE FOR CORRECTING FOR CORRUGATION INDUCED IN A SHEET AS A RESULT OF PASSING THROUGH TRANSPORT NIPS

This invention relates to an electrophotographic copier/printing machine, and more particularly, concerns an improved idler/drive roll nip that removes corrugation(s) in sheets travelling through a predetermined paper path.

In some current copier/printers, a copy sheet transport has idler rollers with minimal axial and angular clearances with respect to their drive rollers, for example, as in U.S. Pat. No. 5,048,813. The lack of these clearances create problems with trapped corrugation between the idler/drive roller nip pairs resulting in paper path jams at any turn roll that will lead sheets away from the top transport. This problem is stressed by large lightweight sheets because there is more sheet length to accumulate corrugation and lower sheet beam strength to resist corrugation being induced. In general, as sheet travels through a transport system it is driven by numerous sheet nips which may introduce corrugation into the sheet. This corrugation may cause sheet buckle and jamming or image deletions on a second pass if the corrugation cannot dissipate before encountering a tight radius turn.

It is therefore an object of this invention to provide idler/drive roll nips that remove sheet corrugation from sheets as they travel within a paper path.

Therefore, the present invention provides a unique idler roller assembly that prevents sheet jams and image deletion by being positioned before any tight radius turn. The idler roller assembly includes a bend in the shaft that supports the idler rollers in order to provide a "toe out" condition to steer out any existing sheet corrugation. A flag feature is included to prevent misinstallation of the shaft in its mounting.

Figure 1:
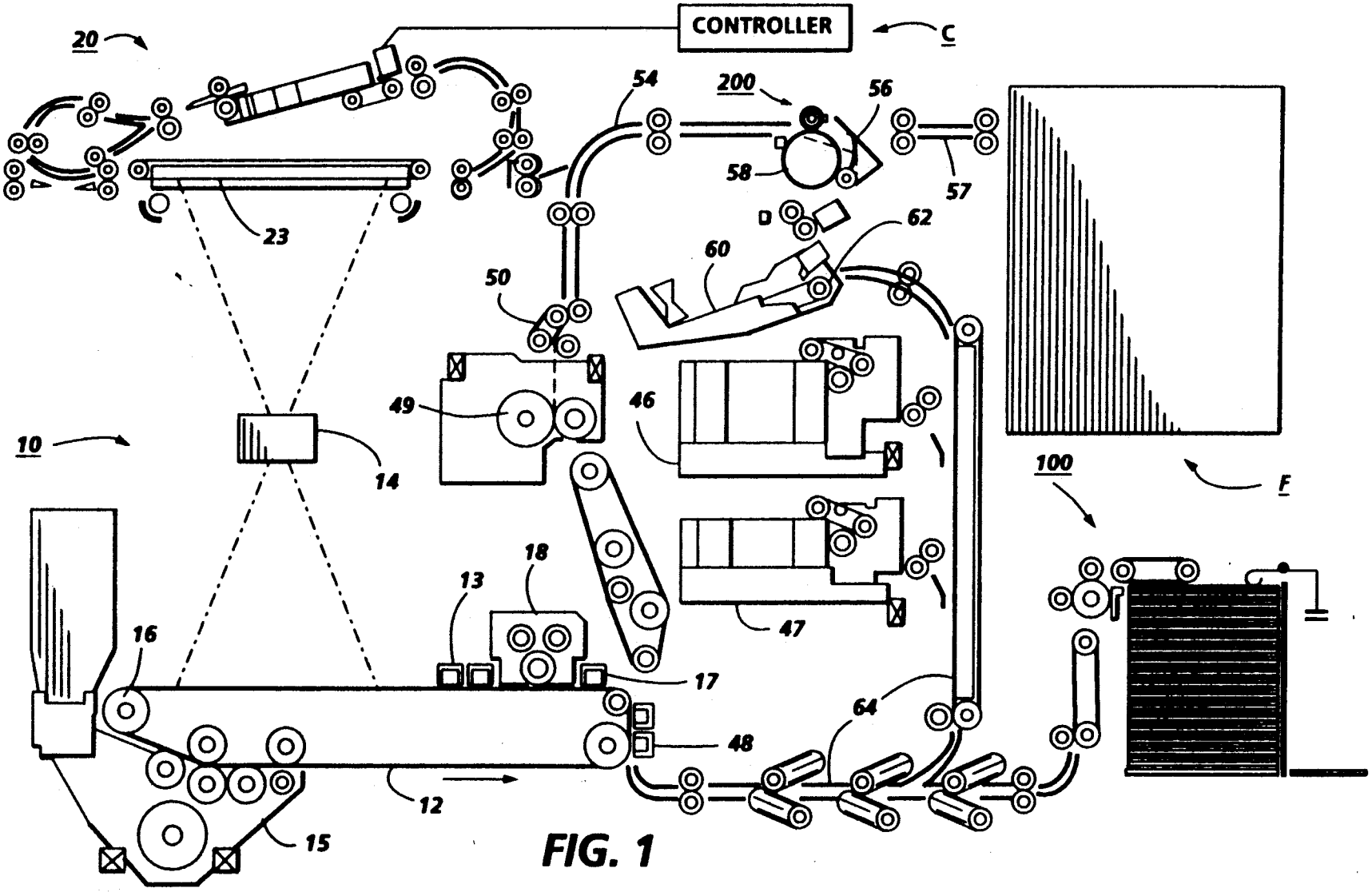
FIG. 1 is a schematic side view of a copier/printer which incorporates the idler roller assembly of the present invention.

Referring now to the drawings in detail, and wherein like numbers indicate like elements, the exemplary copier/printer 10 conventionally includes a xerographic photoreceptor 12 and the xerographic stations acting thereon for respectively corona charging 13, image exposing 14, image developing 15, belt driving 16, precleaning discharge 17 and toner cleaning 18. Documents on the platen 23 maybe imaged onto the photoreceptor 12 through a variable reduction ratio optical imaging system to fit the document images to the selected size of copy sheets.

The control of all machine functions, including all sheet feeding, is, conventionally, by the machine controller "C". The controller "C" is preferably a known programmable microprocessor, exemplified by the microprocessor disclosed in U.S. Pat. No. 4,116,558. The controller "C" conventionally controls all of the machine steps and functions described herein, and other, including the operation of the document feeder 20, all the document and copy sheet deflectors or gates, the sheet feeder drives, the finisher "F", etc. The copier controller also conventionally provides for storage and comparison of the counts of the copy sheets, the number of documents recirculated in a document set, the desired number of copy sets and other selections and controls by the operator through the console or other panel of switches connected to the controller, etc. The controller is also programmed for time delays, jam correction control, etc. Conventional path sensors or switches may be utilized to help keep track of the position of the documents and the copy sheets and the moving components of the apparatus by connection to the controller. In addition, the controller variably regulates the various positions of the gates depending upon which mode of operation is selected.

The copier 10 is adapted to provide either duplex or simplex precollated copy sets from either duplex or simplex original documents presented by the recirculating document handler (RDH) 20. Two separate copy sheet trays 46 and 47 and a multi-ream feeder apparatus 100 are provided for feeding clean copy sheets from either one selectably. They may be referred to as the main tray 46, auxiliary tray 47 and high capacity feeder 100.

The copy sheets are fed from the selected one of the trays 46, 47 or 100 to the transfer station 48 for the conventional transfer of the xerographic toner image of document images from the photoreceptor 12 to the first side of a copy sheet. The copy sheets are then fed by a vacuum transport to a roll fuser 49 for the fusing of that toner image thereon. From the fuser, the copy sheets are fed through a sheet decurler 50. The copy sheets then turn a 90° corner path 54 in the sheet path which inverts the copy sheets into a last-printed face-up orientation and passes through idler roller assembly 200 which removes any corrugation in the copy sheet before reaching a pivotal decision gate 56. The image side which has just been transferred and fused is face-up at this point. If this gate 56 is down it passes the sheets directly on without inversion into the output path 57 of the copier to the finishing module "F". If gate 56 is up it deflects the sheets into a duplex inverting transport 58. The inverting transport (drive roller) 58 inverts and then stacks copy sheets to be duplexed in a duplex buffer tray 60.

The duplex tray 60 provides intermediate or buffer storage for those copy sheets which have been printed on one side and on which it is desired to subsequently print an image or images on the opposite side thereof, i.e. copy sheets in the process of being duplexed. Due to the sheet inverting by the roller 58, these buffer set copy sheets are stacked into the duplex tray 60 face-down. They are stacked in this duplex tray 60 on top of one another in the order in which they were copied.

For the completion of duplex copying, the previously simplexed copy sheets in the tray 60 are fed seriatim by its bottom feeder 62 back to the transfer station 48 for the imaging of their second or opposite side page image. This is through basically the same copy sheet transport path (paper path) 64 as is provided for the clean (blank) sheets from the trays 46, 47 or 100. It may be seen that this copy sheet feed path 64 between the duplex tray 60 and the transfer station 48 has an inherent inversion which inverts the copy sheets once. However, due to the inverting transport 58 having previously stacked these buffer sheets printed face-down in the duplex tray 60, they are represented to the photoreceptor 12 at the transfer station 48 in the proper orientation, i.e. with their blank or opposite sides facing the photoreceptor 12 to receive the second side image. This is referred to as the "second pass" for the buffer set copies being duplexed. The now fully duplexed copy sheets are then fed out again through the fuser 49 and fed out into the output path 57.

The output path 57 here transports the printed copy sheets directly, one at a time, into the connecting, on-line, modular, finishing station module "F". There the completed precollated copy sets may be finished by stapling, stitching, gluing, binding, and/or offset stacking.

Figure 2:
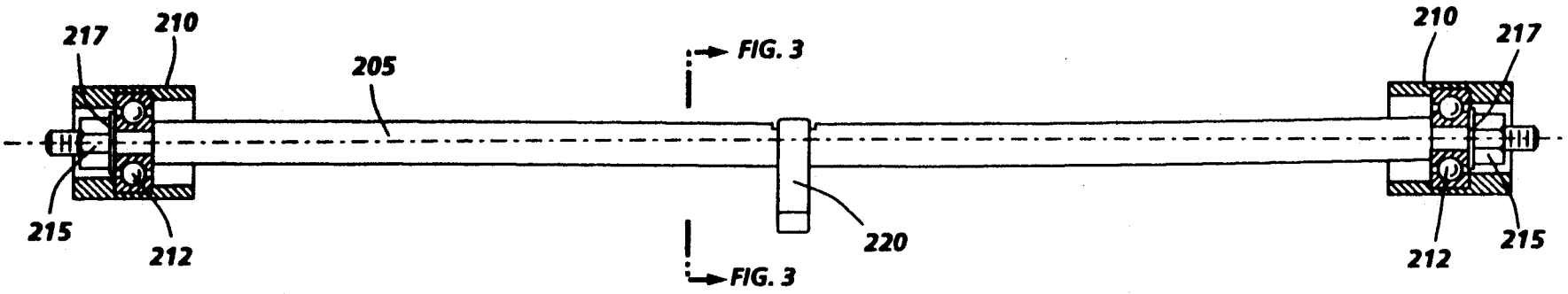
FIG. 2 is a partial plan view of the idler roller assembly of the present invention showing the idler roller mounting shaft being bent to a predetermined degree.

In order to prevent sheet jams and image deletion, idler roller assembly 200 of FIG. 2 is positioned before sharp radius roll 58. This unique idler roller assembly is used to replace existing idler rollers just prior to sharp paper path turns and comprises in combination with a drive roller a nip which has a bend in the idler roller support or mounting shaft to produce a "toe out" condition in order to steer out any corrugation existing in a sheet before the sheet reaches the sharp radius.

Figure 3:
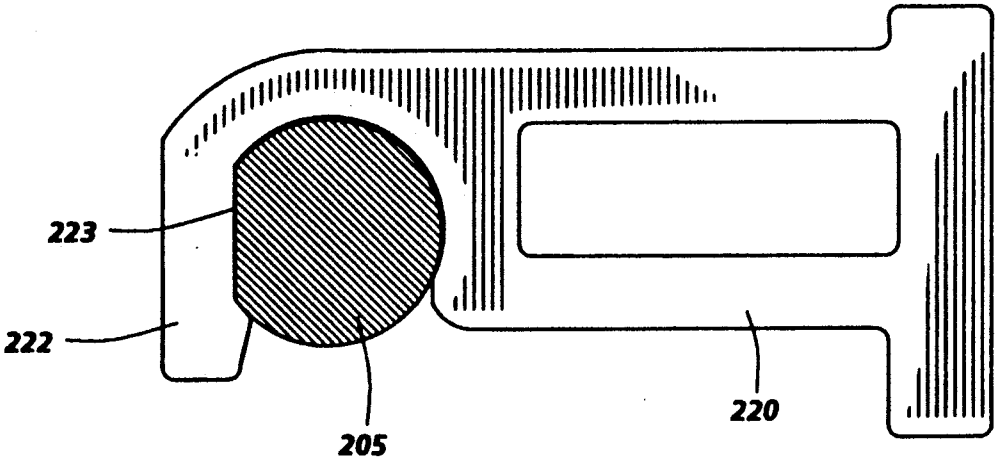
FIG. 3 is an exploded partial, side view of the alignment mechanism used to position the idler roller assembly.

Preferably, a bend of about 0.25 to about 0.75 mm is placed into the middle of shaft 205 as shown in FIG. 2 with a length between idler rollers of 192 mm (inside to inside). The bowed shaft creates a "toe" out orientation to drive out corrugation as the sheet passes through the nip. Idler rollers 210 are mounted on shaft 205 by way of bearings 212. Nuts 215 through washers 217 seat idler rollers 210 against the shoulder of the shaft 205. As shown in FIGS. 2 and 3, an indicator flag or alignment member 220 is snapped onto the shaft of the idler roller assembly (can only snap on to point in one direction) to ensure that the idler roller assembly is installed correctly, thereby avoiding corrugation being induced instead of eliminated. Indicator flag 220 has a hook portion that includes a lip member 222 that must mate with a flat surface 223 of shaft 205 if the idler roller assembly is to be positioned as required. The flag will physically interfere with the idler roller assembly mounting bracket if the idler roller assembly is mis-installed.

Several advantages are obtained with the use of one or more idler roller assemblies 200 including: the ability to make duplex copies absent of image deletions; copies made without creases that are sometimes caused by sheet path corrugations; the ability to avoid jams which could cause unscheduled maintenance calls; and the ability to handle a wide variety of sheet sizes and weights while smoothing out any corrugation in the sheets.

This invention has been described in detail with particular reference to a preferred embodiment thereof, but it will be understood that variations and modifications can be effected within the spirit and scope of the invention and all such variations and modifications are intended to be covered by the appended claims.

We claim:

1. A copier/printer for placing page image information onto copy sheets as they pass through a predetermined paper path includes an idler roller assembly for removing any corrugation in the copy sheets before they reach sharp turns, comprising:

at least one pair of idler rollers;

a non-rotating shaft onto which said at least one pair of idler rollers is mounted, said shaft having a flat side and a predetermined bend therein in order to present a toe out condition to sheets traveling therepast and in cooperation with at least one pair of drive rollers forms nips to thereby steer out any corrugation in the sheets; and an alignment member attached to said shaft for preventing mis-installation of said shaft in a predetermined position within the predetermined paper path, said alignment member having a hooked end with a flat portion that mates with said flat side of said shaft, said alignment member having an extended portion that physically interferes with mounting brackets of the idler roller assembly if said shaft is mis-installed.

2. The copier/printer of claim 1 wherein said bend in said shaft is from about 0.25 to about 0.75 mm.

3. A nip roller assembly that removes corrugation from sheets traveling in a predetermined paper path, comprising:

at least one pair of drive rollers;

at least one pair of idler rollers mating with said at least one pair of drive rollers to form a nip;

a non-rotating shaft onto which said at least one pair of idler rollers is mounted, said shaft having a flat side and a predetermined bend in the middle therein in order to present a toe out condition to sheets traveling through said nip and thereby steer out any corrugation in the sheets; and an alignment member attached to said shaft for preventing mis-installation of said shaft in a predetermined position within the predetermined paper path, said alignment member having a hooked end with a flat portion that mates with said flat side of said shaft, said alignment member having an extended portion that physically interferes with mounting brackets of the idler roller assembly if said shaft is mis-installed.

4. The nip roller assembly of claim 3, wherein said bend in said shaft is from about 0.25 to about 0.75 mm.

* * * * *